US006769329B1

(12) United States Patent
Gao et al.

(10) Patent No.: US 6,769,329 B1
(45) Date of Patent: Aug. 3, 2004

(54) RELEASABLE SOCKET RATCHET WRENCH

(75) Inventors: Hua Gao, Foxpoint, WI (US); James A. Rinner, Racine, WI (US)

(73) Assignee: Pilling Weck Incorporated, Horsham, PA (US)

( * ) Notice: Subject to any disclaimer, the term of this patent is extended or adjusted under 35 U.S.C. 154(b) by 11 days.

(21) Appl. No.: 10/151,327

(22) Filed: May 21, 2002

(51) Int. Cl.[7] ..... B25B 13/46
(52) U.S. Cl. ..... 81/60; 81/61
(58) Field of Search ..... 81/60–63.2

(56) References Cited

U.S. PATENT DOCUMENTS

| | | | | | |
|---|---|---|---|---|---|
| 61,340 | A | | 1/1867 | Jackson | |
| 193,301 | A | | 7/1877 | Vassar | |
| 556,151 | A | * | 3/1896 | Johnson | 81/61 |
| 627,269 | A | * | 6/1899 | Polliard | 81/61 |
| 810,599 | A | | 1/1906 | Ansorge | |
| 864,007 | A | | 8/1907 | Lyon | |
| 896,607 | A | | 8/1908 | Zeller | |
| 1,157,427 | A | * | 10/1915 | Seivert | 81/60 |
| 1,350,315 | A | | 8/1920 | Katzmarek | |
| 1,868,840 | A | | 7/1932 | McNaught et al. | |
| 2,300,479 | A | | 11/1942 | Wilson | |
| 2,735,324 | A | | 2/1956 | Goldwater | |
| 2,757,564 | A | * | 8/1956 | Reaves | 81/61 |
| 2,805,589 | A | * | 9/1957 | Barber | 81/61 |
| 2,810,313 | A | * | 10/1957 | Hermanson | 81/61 |
| 3,838,614 | A | | 10/1974 | O'Donnell | |
| 4,080,851 | A | | 3/1978 | Rogers | |
| 4,151,763 | A | | 5/1979 | Colvin | |
| 4,308,768 | A | | 1/1982 | Wagner | |
| 4,515,044 | A | | 5/1985 | Harstad | |
| 4,592,255 | A | | 6/1986 | Mayer | |
| 4,703,676 | A | | 11/1987 | Mayer | |
| 4,934,220 | A | | 6/1990 | Slusar | |
| 5,197,358 | A | * | 3/1993 | Hsu | 81/60 |
| 5,507,208 | A | | 4/1996 | Pratt | |
| 5,636,557 | A | | 6/1997 | Ma | |
| 5,713,251 | A | | 2/1998 | Zurbuchen | |
| 5,927,158 | A | | 7/1999 | Lin | |
| 5,979,274 | A | | 11/1999 | Hsieh | |
| 6,050,165 | A | | 4/2000 | Hall | |
| 6,070,502 | A | | 6/2000 | Chang | |
| 6,282,993 | B1 | | 9/2001 | Forman | |
| 6,289,771 | B1 | | 9/2001 | Hsieh | |
| 6,516,689 | B1 | * | 2/2003 | Bates | 81/60 |

* cited by examiner

*Primary Examiner*—Debra Meislin
(74) *Attorney, Agent, or Firm*—Arthur J. Hansmann

(57) ABSTRACT

A ratchet wrench with a releasable socket which is rotatable in a handle circular pocket and the socket extends on the wrench for only the thickness of the handle and does not protrude beyond the handle. The socket is symmetrical in its configuration and is therefore reversible in its position in the pocket and it still produces the same rotational drive. A pawl and spring are on the handle, and the pawl is snug with the socket to hold the socket in an axially fixed position on the handle. The pawl protrudes from the handle and indicates the rotational drive direction required of the handle. Fluid clean-out holes extend into the pocket.

9 Claims, 3 Drawing Sheets

Fig. 1
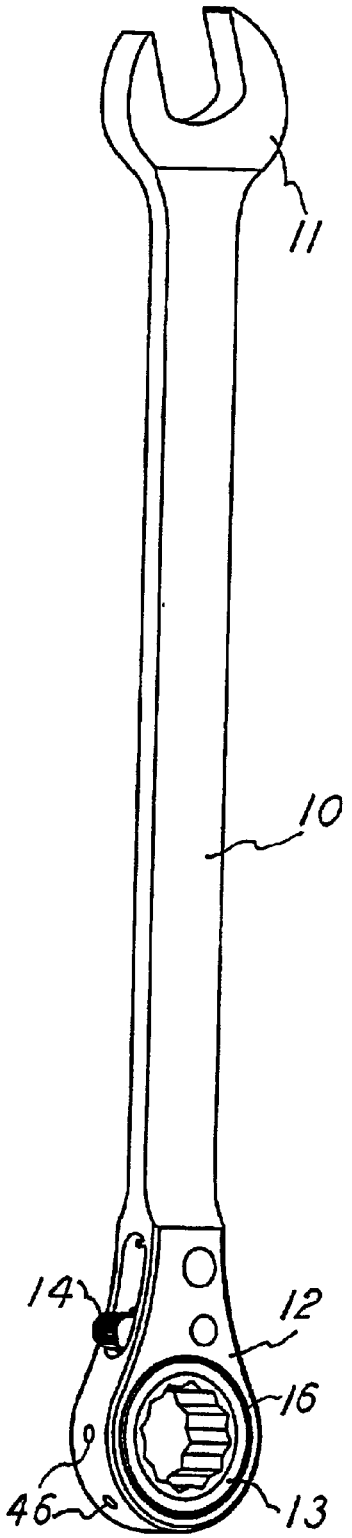
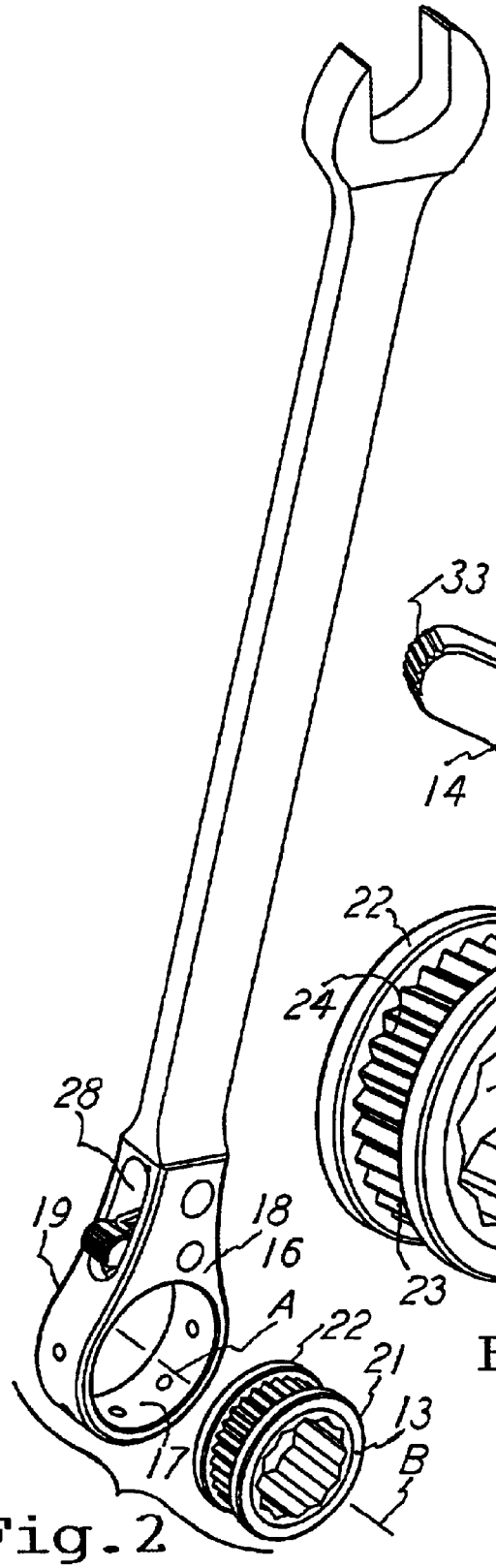
Fig. 2
Fig. 4
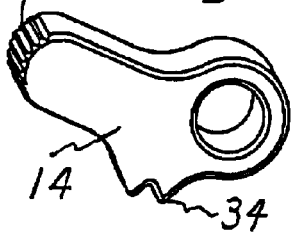
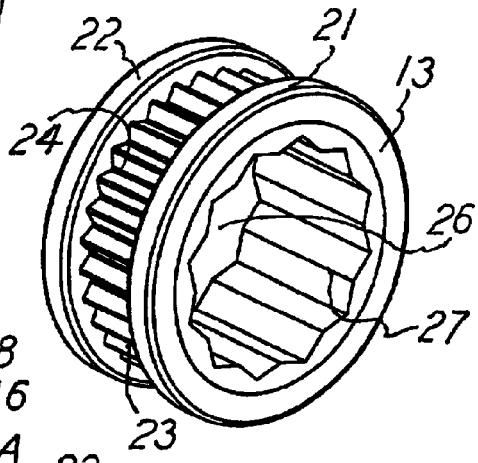
Fig. 3

RELEASABLE SOCKET RATCHET WRENCH

This invention relates to socket wrenches, and more particlarly, it relates to socket wrenches wherein there is a releasable, and replaceable, socket snugly presented in a wrench, and it is particulary useful in medical procedures.

BACKGROUND OF THE INVENTION

The prior art is aware of wrenches having replaceable sockets wherein there is a socket which is received in a pocket in the supporting wrench. The socket can be removed from the handle of the wrench, and it can be replaced by another socket of a different size for the driving function. Thus, the sockets are of varying sizes according to the size and configuration of the item to be rotatably driven by the wrench.

Also, those wrenches have their pockets open on both sides of the wrench so the sockets can be withdrawn and inserted relative to both sides of the wrench. Still further, the prior art is aware of wrenches wherein there is a pawl pivotal on the wrench and extending into contact with the socket to releasably hold the socket in both the tooth-engaged rotational direction and the socket-rotation axial direction.

That is, in the prior art, the socket extends beyond the receiving pocket, and thus the functioning forces act at the over-extending sockets ends to tend to angulate the socket in the pocket. That can upset the desired snug fit between the socket and the remainder of the wrench and render the wrench imprecise through its looseness. Also, the over-extending socket ends make the socket too large for uses where space and precision are important. Additionally, the over-extending socket if difficult to align with the wrench pocket because it is not readily apparent when the socket is centered with the pocket, so the socket actually might not be aligned with its pawl though it is at least partially in the pocket.

The present invention improves upon the prior art by providing a socket wrench wherein the sockets have the aforementioned features and also have improved sturdiness and consequent precision. That is, the socket is supported in the wrench pocket in a manner to avoid the common tendency of tilting the socket in the pocket by exposing the socket to forces on the ends of the socket at locations where the socket is not actually being supported by the wrench. Thus, there is a releasable socket wrench where the axial length of the socket does not extend beyond the width of the wrench, so the socket does not protrude beyond the wrench pocket and is therefore firm in the assembly.

Also, the socket has symmetrical V-shaped teeth, so which ever orientation the socket has in its insertion into the handle pocket, the drive function will always be in the same rotational direction. Either end of the socket can be inserted into either side of the handle, and the rotational drive will always be in the same direction. In fact, that drive direction is always toward the protruding end of the pawl, so the user will always know to rotate toward that protruding end and the wrench will be in the rotational drive mode.

Additionally, this invention is of a releasable socket wrench which has clean-out holes extending through the wrench body and to the socket, if the socket is in place during cleaning, for fluid cleaning of the socket and its pocket.

In essence, this invention provides a sturdy, precise, compact, cleanable, and releasable socket wrench, wherein the socket can be moved relative to the pocket from either side of the wrench, the pawl itself holds the socket in its releasable position, and the socket does not extend beyond the width of the wrench. Throughout all that, the socket can be inserted into the pocket from either side of the wrench and the wrench will produce the same ratcheting action all the time. That is, the socket can not be inadvertently inserted in a manner to produce two different rotational ratcheting directions.

BRIEF DESCRIPTION OF THE DRAWINGS

FIG. 1 is a perspective view of a preferred embodiment of the wrench of this invention.

FIG. 2 is an exploded perspective view of the wrench shown in FIG. 1.

FIGS. 3 and 4 are enlarged perspective views of two parts seen in FIG. 1.

DETAILED DESCRIPTION OF A PREFERRED EMBODIMENT

Figure 5:
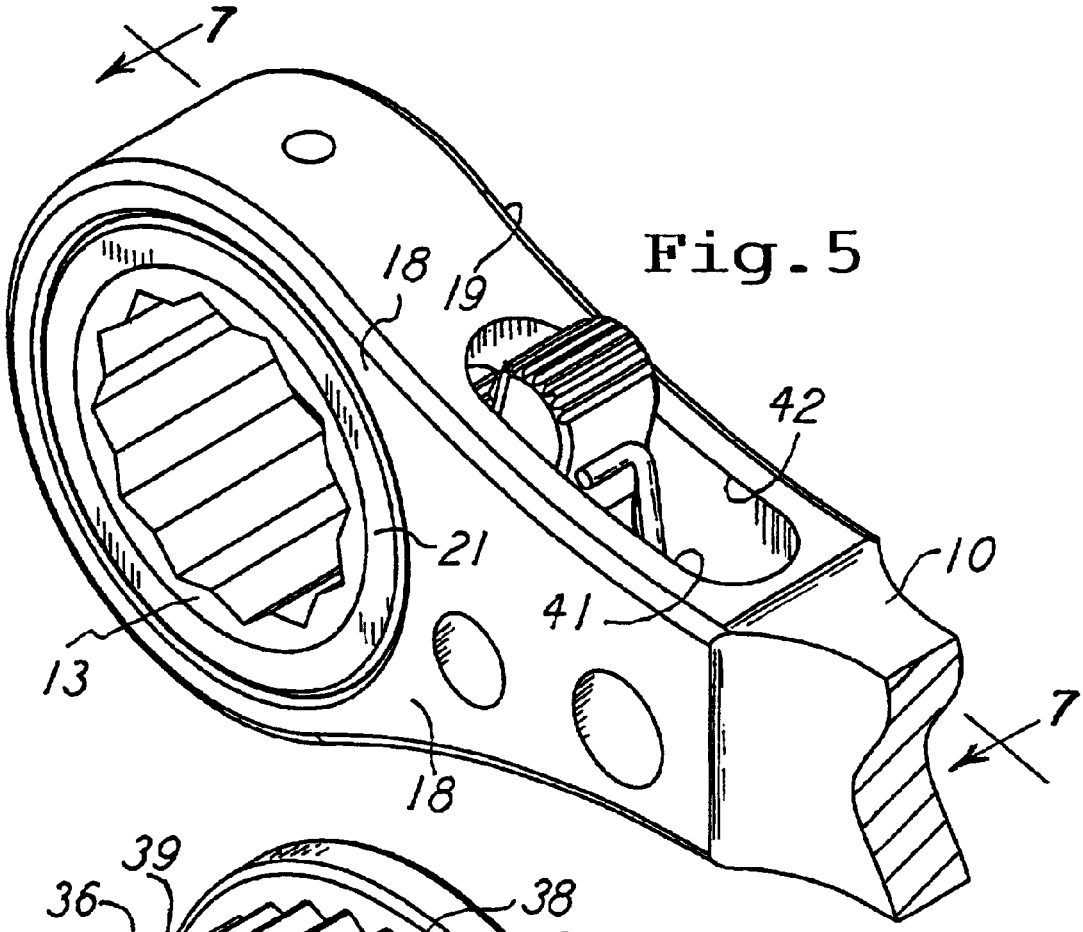
FIG. 5 is an enlarged perspective view of the lower portion of FIG. 1.

FIGS. 1 and 2 show the wrench of this invention wherein there is a handle 10 having two opposite ends 11 and 12. The end 11 can be an open end for rotationally engaging the usual but unshown nut or bolt head. The end 12 is the ratcheting end which includes a releasable cylindrical socket 13 and a pivotal pawl 14.

The handle end 12 has a circular pocket or opening 16 which is defined by a cylindrical wall 17 of one continuous and uniform diameter throughout the length of the pocket along its longitudinal axis A. The wall 17 has the finite length which extends fully between the two parallel sides 18 and 19 of the wrench handle 10. Thus the wall 17 has two terminal and circular ends at those sides 18 and 19.

The socket 13 is cylindrical in its shape along its longitudinal axis B. It is preferably made of one piece of metal and it has two axially spaced-apart and cylindrical rims 21 and 22 which have the same outer diameter which is substantially the same as the diameter of the cylindrical wall 17. The arrangement is such that the socket 13 is releasable and it fits rotationally snugly into the pocket 16. That is, the socket rims 21 and 22 continuously circularly contact the circular wall 17 adjacent the handle sides 18 and 19 in the assembled relationship therebetween. Also, the axial lengths of both the wall 17 and the socket 13 are the same, and thus the socket 13 does not extend beyond the handle sides 18 and 19, such as seen on the side 18 in FIGS. 1 and 5, and it will likewise be understood that the socket does not extend beyond the handle side 19. On both sides and ends the socket 13 has a full length that is only that of the length of the pocket 16, and that is the axial length of the wall 17.

The socket 13 has a central portion 23 which is circumferentially recessed relative to the outer diameters of the rims 21 and 22 which are smooth on their outer circular surfaces. Ratchet teeth 24 extend throughout the circumference of the central portion 23 and they face radially outwardly. The teeth 24 are uniform in their radial projection in that they are not slanted mainly to only one side around the circumference. Thus, the teeth 24 are symmetrical and V-shaped, and the socket 13 can be positioned with either end 21 or 22 adjacent the handle sides 18 and 19 and there would be no difference in the ratcheting action. The socket 13 is H-shaped in a cross-section along the axis B.

The central portion 26 of the socket 13 is hollow and is defined by rotation drive teeth or flats 27 of any convention configuration such as the shown twelve-point, square, hexagonal or the like shape, and they face radially inwardly for engaging the nut or bolt which is to be rotated by the wrench.

Figure 7:
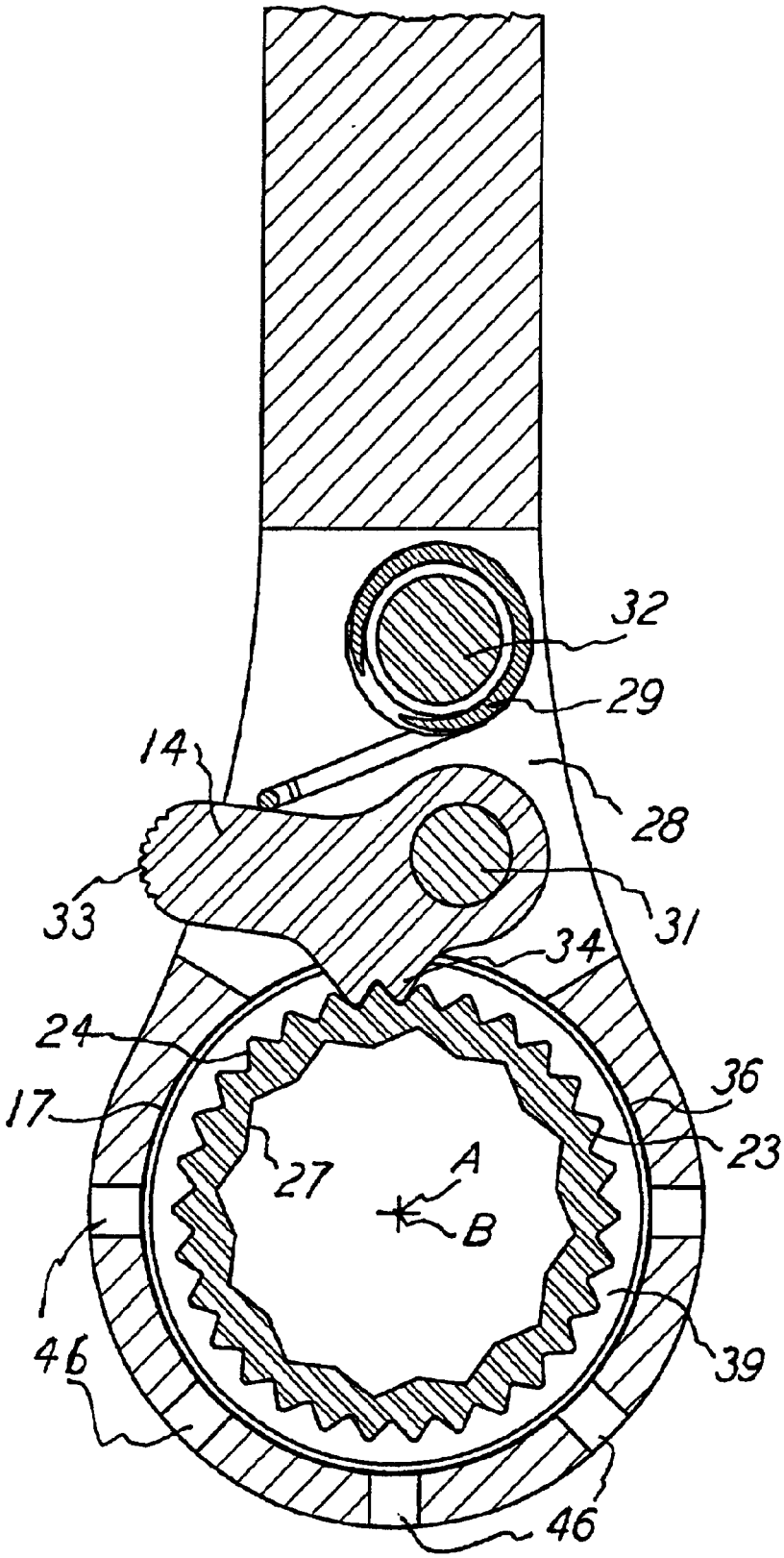
FIG. 7 is a sectional view taken on a plane designated by the line 7—7 on FIG. 5.

The handle 10 has an opening 28, as best seen in FIG. 7, for reception of the pawl 14 and a pawl spring 29 which are respectively piloted on pins 31 and 32 affixed to the handle 10 and extending thereacross. The pawl 14 has an extending knurled end 33 which projects beyond the handle 10 to be available for thumb pressure by the surgeon or other user. The pawl also has V-shaped teeth 34 faced toward and meshable with the socket teeth 23 to hold the socket 13 against rotation when so desired. The locations of the pin 31 and the engagement of the teeth 23 and 34 provide for selective restraining of the rotation of the socket 13 in one direction when the teeth are engaged. Of course, the socket can ride over the pawl teeth with its own teeth 23 when rotation of the handle is in the ratcheting direction, such as the clockwise direction as seen in FIG. 7. That means that the handle would be rotated about axis A in the counter-clockwise direction, as it is viewed in FIG. 7, to produce the rotational drive to the socket 13. The socket teeth 23 are symmetrical in that they are so about a radial line from the axis B, and, similar to the socket teeth 23, the pawl teeth 34 are symmetrical, and that provides for the assembly versatility mentioned.

The spring 29 is a torsion spring and it therefore forces against the pawl 14 to yieldingly urge the pawl into engaged relationship with the socket 13 for the rotation drive from the handle to the socket, as desired.

A feature is that the socket 13 can be inserted into the pocket 16 from either handle side 18 or 19, and either end 21 or 22 of the socket can be inserted first, and those assembly variations would not affect the rotational direction of the ratcheting action. The wrench itself would not have to be turned over relative to its axis A. Additionally, the pawl end 33 always protrudes to the rotational drive direction on the handle 10 thus showing the rotational drive direction, and that is always so, regardless of which end of the socket 13 is inserted into which side 18 or 19 of the handle.

Figure 6:
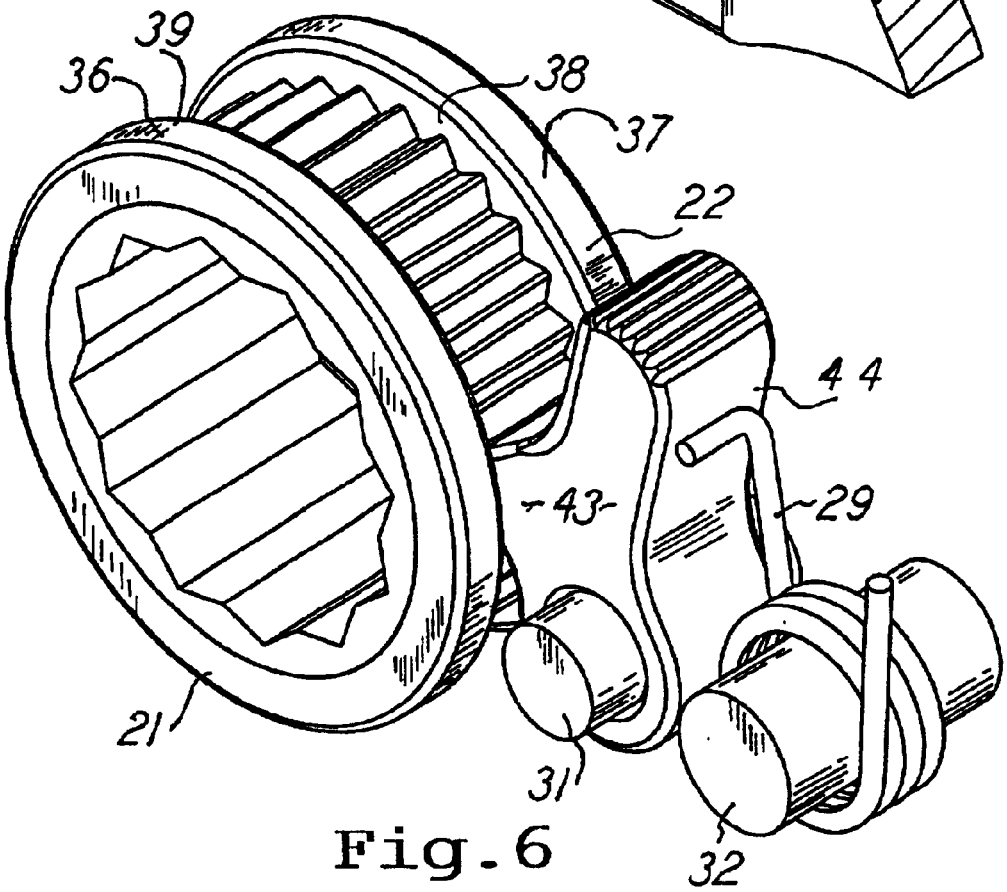
FIG. 6 is a perspective view of FIG. 5 but with the wrench handle omitted.

As best seen in FIG. 6, the socket 13 has circumferential surfaces 36 and 37 on rims 21 and 22, and those surfaces are snugly disposed on the handle circular surface 17 to be in rotational bearing relationship therewith. Also, the rims 21 and 22 have inwardly facing and axially spaced apart circular walls 38 and 39. The axial length or spacing between the walls 38 and 39 is the same, or only slightly greater than the thickness of the pawl 14 along the axis of the pawl pin 31.

Also, the handle has side walls 41 and 42 which are spaced apart the thickness of the pawl 14 to be available to position the pawl 14 relative to the handle 10. Thus, with the pawl 14, by its side walls 43 and 44 engaged with the handle walls 41 and 42, or with the pawl 14 being axially fixed on its pin 31, and with the pawl's engagement of the socket walls 38 and 39, the pawl 14 axially pilots and restrains the socket 13 along the axis A. Only when the pawl 14 is depressed against the spring 29 can the socket 13 be removed or released from the handle 10, and that is when the pawl, at its tooth end 34, is retracted from between the socket walls 38 and 39. The H-shape of the socket 13 fits snugly with the thickness of the pawl 14 until retraction.

The handle has its circular end at 12 with passageways 46 extending therethrough for cleaning the interior of the wrench including the socket 13, if it is then in its pocket 16, and cleaning the interior of the handle end 12. That is important in the medical use of the wrench.

While a specific embodiment of the wrench is shown and described, as required for one full disclosure, it should be understood that equivalent changes can be made relative to that embodiment, and the scope of this invention should be construed by the claiming.

What is claimed is:

1. A ratchet wrench with a removable socket, comprising:

a wrench handle having a pocket defined by an endless circular wall which has a longitudinal axis central to said circular wall and which terminates in two ends spaced apart along said axis and which has a total axial length extending fully between said ends and which has two circular openings of the same diameter extending at and through respective said ends and centered on said longitudinal axis and said handle having an opening extending through said circular wall and into said pocket, a cylindrical socket having a longitudinal axis co-extensive with said pocket longitudinal axis and having two circular rims spaced apart along said longitudinal axis and with said socket having a circular depression centered on and extending around said longitudinal axis and disposed between said rims, said socket being disposed in said pocket and being of a total axial length along said longitudinal axis at least that of said pocket total axial length and with said rims being in snug and endless rotational contact with said endless circular wall at said ends and with said socket being axially movable along said axis and slideable into and out of said pocket through either of both said circular openings, said socket having socket ratchet teeth in an endless circular pattern in said circular depression and having a recess for engaging a member to be rotationally driven by said socket, a pawl movably mounted in said handle opening and extending into said socket circular depression between said rims and having an interference fit with said rims in both axial directions relative to said longitudinal axis to thereby releasably hold said socket axially in said pocket, teeth on said pawl for ratcheting engagement with said socket ratchet teeth and with said handle being rotatable about said axis and around said socket for ratchet action, and each of said teeth on both said socket and said pawl have two intersecting sides which present a V-shape in a view along said axis and with said sides being of equal dimension in their full extent in said view and a point on said teeth where said sides intersect each other and with each of said teeth thereby being symmetrical in shape in the view along said axis and relative to a radial line extending from said axis and through said point, to thereby have said socket always operable for ratcheting action in one direction of rotation of said handle about said axis and regardless of which axial end of said socket first slideably enters said pocket at either one of said circular openings.

2. The ratchet wrench with a removable socket, as claimed in claim 1, wherein:

said pocket is defined by having said circular wall extend with only one continuous diameter throughout the entire axial length of said pocket to thereby have said pocket free of any obstruction along said circular wall throughout said entire axial length of said pocket.

3. The ratchet wrench with a removable socket, as claimed in claim 1, wherein:

said pawl has a thickness extending in the axial direction of said socket and said thickness is substantially the same as the spacing between said rims for snugly holding said socket on said handle in said axial direction.

4. The ratchet wrench with a removable socket, as claimed in claim 1, including:

a spring on said handle and engaged with said pawl for yieldingly urging said pawl radially inward along said radial line and into tooth engagement with said socket.

5. The ratchet wrench with a removable socket, as claimed in claim 1, wherein:

said handle has passageways spaced around said handle and extending therethrough and open to said pocket for flushing said pocket with cleaning fluid passing through said passageways.

6. A ratchet wrench with a removable socket, comprising:

a wrench handle having two spaced-apart exterior wall surfaces on respective spaced-apart planes and having a pocket defined by a circular wall which has an axial length and a diameter which is the same throughout the entirety of said axial length of said pocket and with said circular wall extending fully between and completely terminating at said wall surfaces in its said axial length and said handle has an opening therethrough extending into said pocket, a cylindrical socket having a longitudinal axis and being H-shaped in profile view perpendicular to said longitudinal axis and having two spaced-apart circular portions, as represented by the two upright portions of the letter H, and with said circular portions respectively terminating at said wall surfaces and on said planes and with said socket having a circular depression between said circular portions, said socket being disposed in said pocket and being of a total longitudinal axial length to extend fully and only between said wall surfaces and with said circular portions being in snug and rotational contact with said circular wall and with said socket being insertable into and movable out of said pocket and past either one of said wall surfaces, V-shaped socket ratchet teeth on said socket at said circular depression and being shaped to have each of said socket teeth present a symmetrical and the same profile view of said teeth in an axial end view in either axial direction along said axis and said socket having a recess extending along said axis throughout said socket axial length and with said recess being in a single dimension radial of said axis throughout said socket axial length for engaging a member throughout said socket axial length and from either axial end of said socket for rotationally driving said member, a pawl movably mounted in said handle opening and extending between said circular portions for releasably axially holding said socket in said pocket and being movable away from said portions, V-shaped teeth on said pawl for ratchet engagement with said socket teeth and with each of said pawl teeth being symmetrical in axial views in both directions along said axis, said socket is identical in said profile view thereof from an axial end view thereof in either direction along said axis and is therefore configured to be insertable into said pocket with either axial end of said socket entering said pocket first and thereby produce the same ratcheting function with the rotation of said handle in one selected rotative direction and with either insertion direction of said socket, and a spring operative on said pawl for urging said pawl into tooth engagement with said socket ratchet teeth.

7. The ratchet wrench with a removable socket, as claimed in claim 6, wherein:

said pocket is defined by having said circular wall extend in only one continuous diameter throughout the entire axial length of said pocket and thereby said pocket is free of any obstruction in the axial direction of said circular wall.

8. The ratchet wrench with a removable socket, as claimed in claim 6, wherein:

said handle including an axis, and said pawl is pivotal about said handle axis and has a thickness extending in the axial direction of said pawl and said thickness is substantially the same as the spacing between said portions for snugly holding said socket on said handle in said axial direction.

9. The ratchet wrench with a removable socket, as claimed in claim 8, wherein:

said pawl protrudes beyond said handle opening toward one direction of rotation of said handle for indicating the ratcheting direction of said wrench.

* * * * *